US005645141A

United States Patent [19]

Tseng

[11] Patent Number: 5,645,141

[45] Date of Patent: Jul. 8, 1997

[54] HOIST FOR ROLL MATERIAL SURFACE TREATMENT

[76] Inventor: Shou Tang Tseng, No.4, Chungsan Rd., Heng San Tsun, Ta Ya Conuty, Taichung, Taiwan

[21] Appl. No.: 530,923

[22] Filed: Sep. 20, 1995

[51] Int. Cl.[6] ..... B66B 9/02

[52] U.S. Cl. ..... 187/269; 414/711

[58] Field of Search ..... 187/24 B, 269, 187/211, 401; 414/910, 911, 610, 592

[56] References Cited

U.S. PATENT DOCUMENTS 5,308,217 5/1994 Pienta ..... 414/910

5,421,691 6/1995 Fennone ..... 414/911

*Primary Examiner*—Kenneth Noland

*Attorney, Agent, or Firm*—Bacon & Thomas

[57] ABSTRACT

A hoist for roll material surface treatment composes of a lift platform means, a securing means, a hoist means and a transmission means. There are two pairs of spaced bars in the hoist means engagable with two pairs of spaced V-shape blocks in the securing mean allowing the hoist means to load or discharge a roll material supported by the lift platform means. There are rotary shafts in the hoist means for suspending the roll material through the central opening thereof The roll material is compressed between layers at the upper portion and stretched to form loosely gap between layers at the lower portion. The roll material is hoisted and immersed in a processing tank. When rotary shaft and the roll material are driven to rotate by the transmission means, the upper portion of the roll material squeeze out the processing liquid while the lower portion allow processing liquid to sip into the gap and uniformly cover the surface of the roll material. Thus roll material can get a uniform surface treatment.

5 Claims, 9 Drawing Sheets

HOIST FOR ROLL MATERIAL SURFACE TREATMENT

BACKGROUND OF THE INVENTION

1. Field of the Invention

The invention relates to a hoist for roll material surface treatment and particularly to an apparatus which has power transmission means and rotary shaft to enable a roll material rotating in the processing liquid for achieving uniform surface treatment.

2. Description of the Prior Art

A roll or coil material is usually formed by winding and laminating a thin strip of material such as steel wire or sheet in annular crossection.

As steel wire or sheet is formed by drawing, extension or extrusion during the production process, it prones to oxidize. Oxidization also takes place when a roll of steel wire or sheet being stored in the stockroom. It therefore needs surface treatment to prevent exidization.

Conventional surface treatment for roll material includes an electric hoist to suspend a roll material in the processing liquid and to generate up and down vibration on the roll for allowing processing liquid to sip between laminates and cover the surface of the material. As the roll of material being laminated and stacked tightly, it usually results in too small gap between two laminates. Processing liquid can not uniformly covers the entire surface thus resulting in not effective surface treatment.

SUMMARY OF THE INVENTION

It is therefore an object of the invention to provide a more effective hoist for roll material surface treatment. According to the invention, a roll material is suspended on a rotary shaft with the upper portion being compressed tightly by its own weight and the lower portion being stretched and loosely laminated so that processing liquid can be effectively applied on the surface of the lower protion while being squeezed out at the upper portion.

BRIEF DESCRIPTION OF THE DRAWINGS

The drawings disclose illustrative embodiments of the present invention which serve to exemplify the various advantages and objects hereof; and are as follows.

DETAILED DESCRIPTION OF THE PREFERRED EMBODIMENTS

Figure 2:
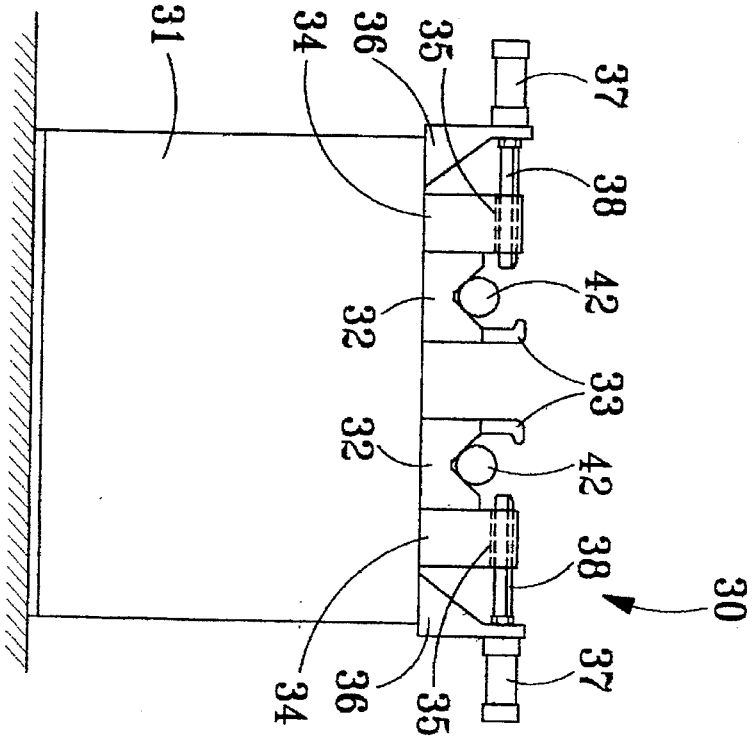
FIG. 2 is a side view of the invention.
Figure 1:
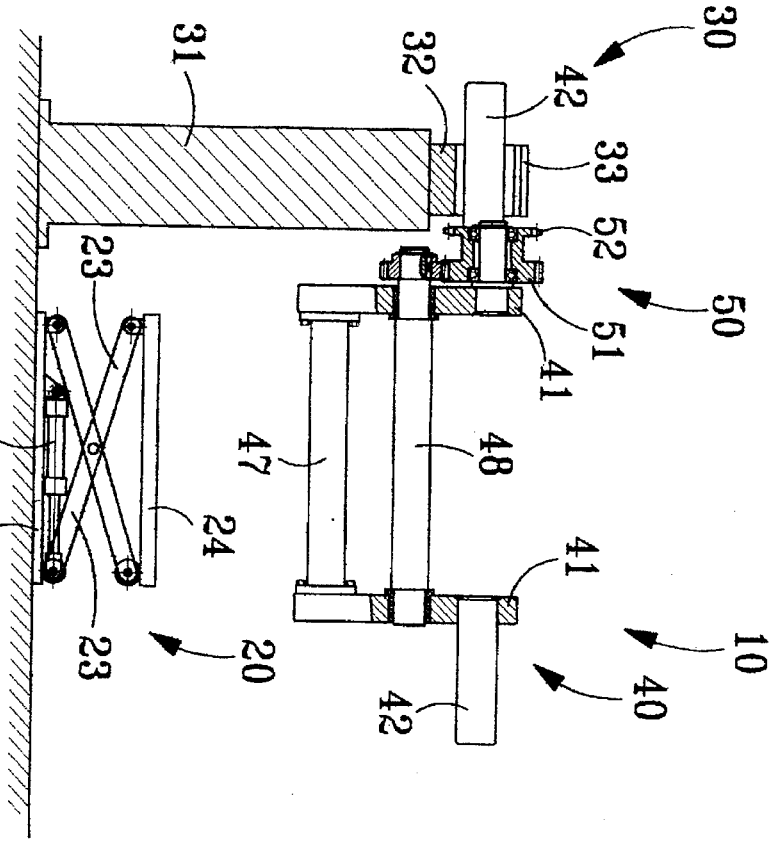
FIG. 1 is a sectional view of the invention.

Referring to FIGS. 1 and 2, hoist 10 according to the invention mainly composes of a lift platform means 20, a securing means 30, a hoist means 40 and a transmission means 50. Lift platform means 20 includes a base 21 located on the floor. A cylinder 22 is disposed above the base 21. one end of cylinder shaft is secured to a linkage bar of a pair of cross linkage bars 23 pivotally engaged with each other. There is a platform 24 disposed on another ends of linkage 23. Thus when the cylinder shaft of cylinder 22 is extended or withdrawn, linkage bars 23 will be moved upward or downward. The platform 24 subsequently will also be moved vertically upward or downward.

Securing means 30 locates beside the hoist means 20, It includes a base frame 31 having two V-shape blocks 32 disposed on the top surface. There is an upward flange 33 with a protrusive edge disposed on one side thereof and a holding seat 34 disposed on another side. An inverted T-shape slot 35 is formed at the upper portion of the holding seat 34. Beside the holding seat 34 and on the top surface of the base frame 31, there is an anchor block 36 with a cylinder 37 horizontally disposed thereon. Cylinder 37 has a poiston shaft 38 extending horizontally outward which is engagable with the protrusive edge of the flange 33.

Figure 3:
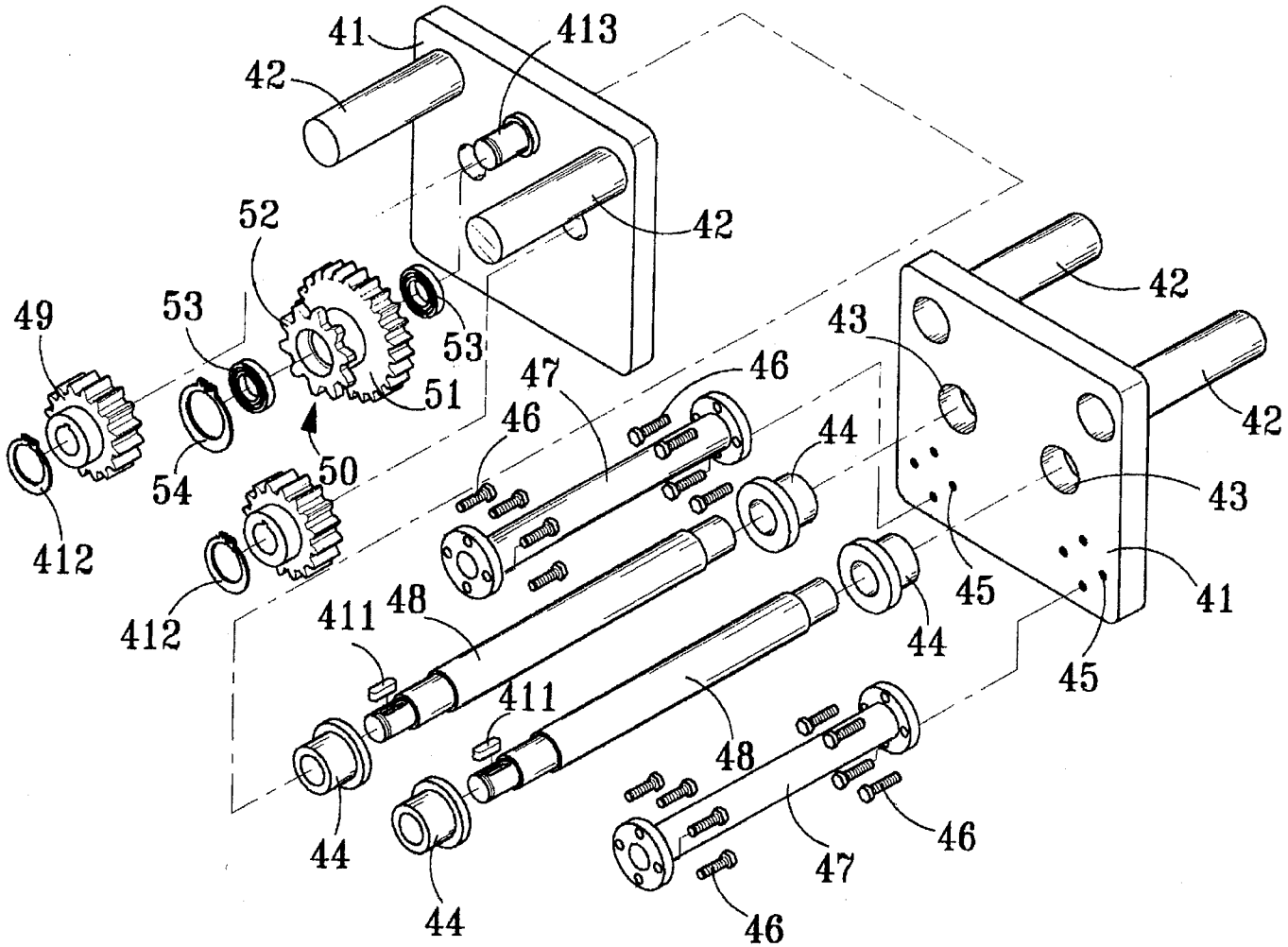
FIG. 3 is an exploded view of a hoist means and a transmission means of the invention.
Figure 4:
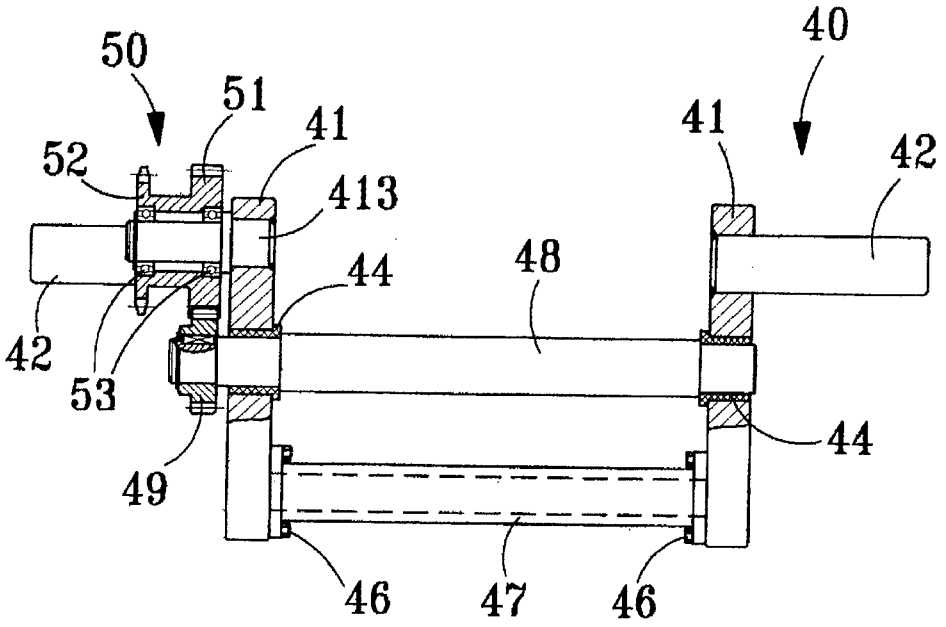
FIG. 4 is a sectional view of a hoist means and a transmission means of the invention.
Figure 5:
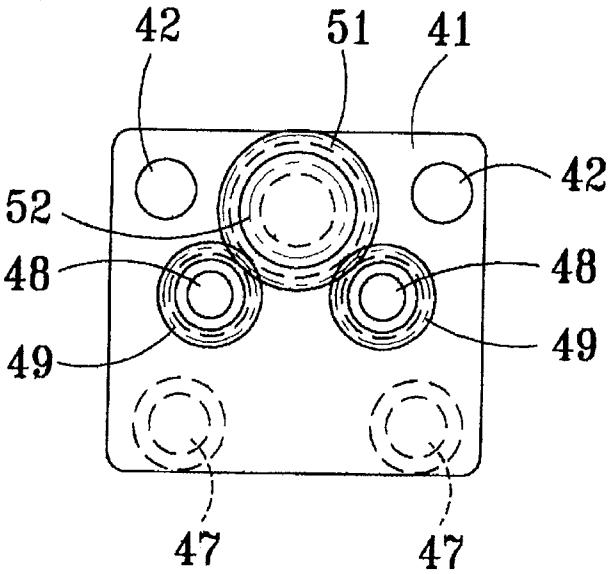
FIG. 5 is a side view taken from FIG. 4.

Hoist means 40 is located above the lift platform 20 (also referring to FIGS. 3,4 and 5). It includes a pair of spaced supporting board 41 vertically disposed. There is a pair of spaced suspending bars 42 horizontally disposed on each supporting board 41. The supporting boards 41 are connected to each other by a pair of spaced support beams 47 through bolts 46 and screw holes 45. The supporting board 41 further has a pair of spaced openings 43 formed therein. A rotary shaft 48 with bushings 44 disposed at both ends is disposed in a pair of openings 43 formed in the supporting board 41. One end of rotary shaft 48 is extended outside of the supporting board 41 and is engaged with a driven gear 49. Gear 49 is fixed on the rotary shaft 48 by means of a key 411 and a circlip, 412. In the supporting board 41 which has a driven gear 49, there is provided a gear shaft 413 which has the transmission means 50 disposed thereon.

The transmission means 50 includes a driving gear 51 integrally formed with a chain wheel 52 which is disposed on the gear shaft 413 by means of a pair of bearings 53 and a circlip 54. Driving gear 51 engages with the driven gear 49.

Figure 6:
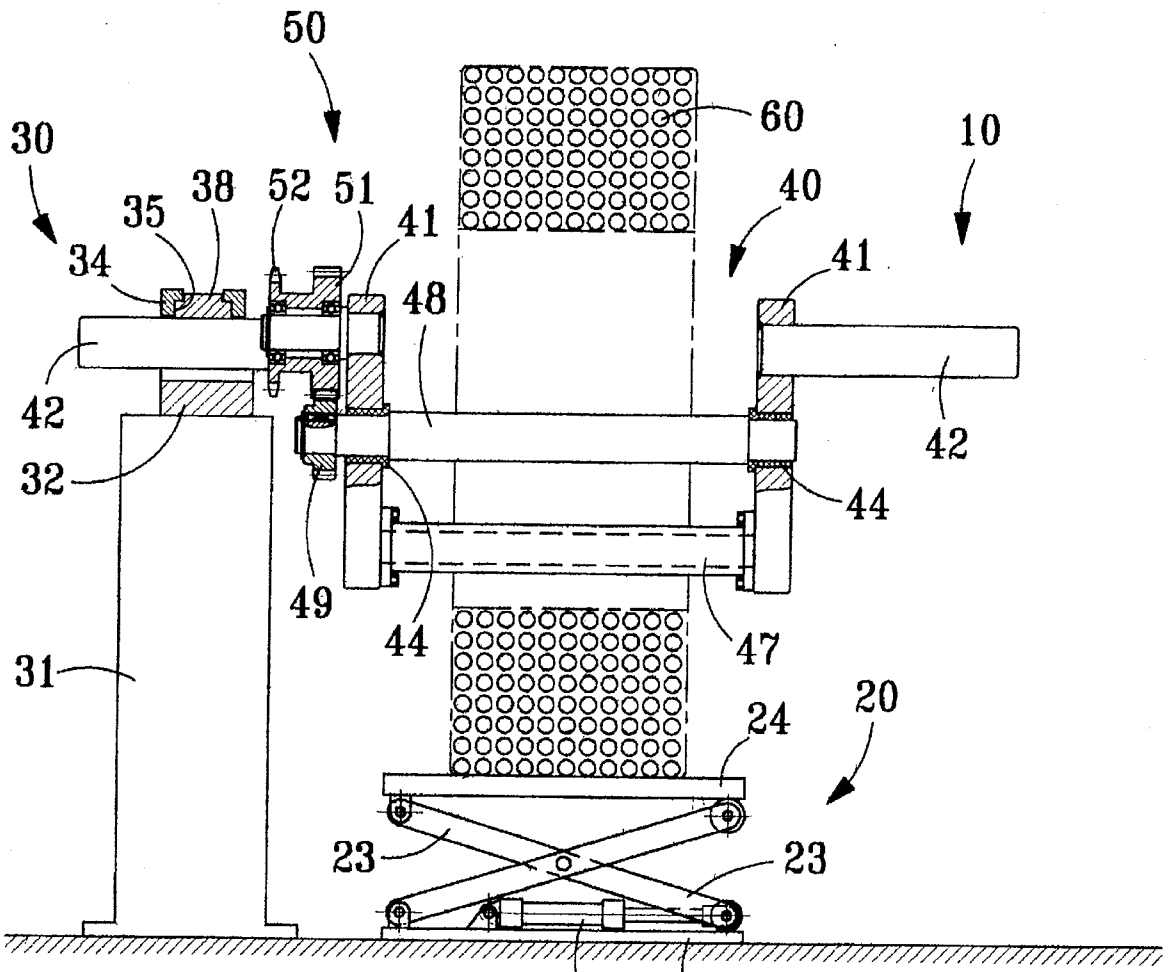
FIG. 6 is a sectional view of the invention including a roll materal disposed therein.
Figure 7:
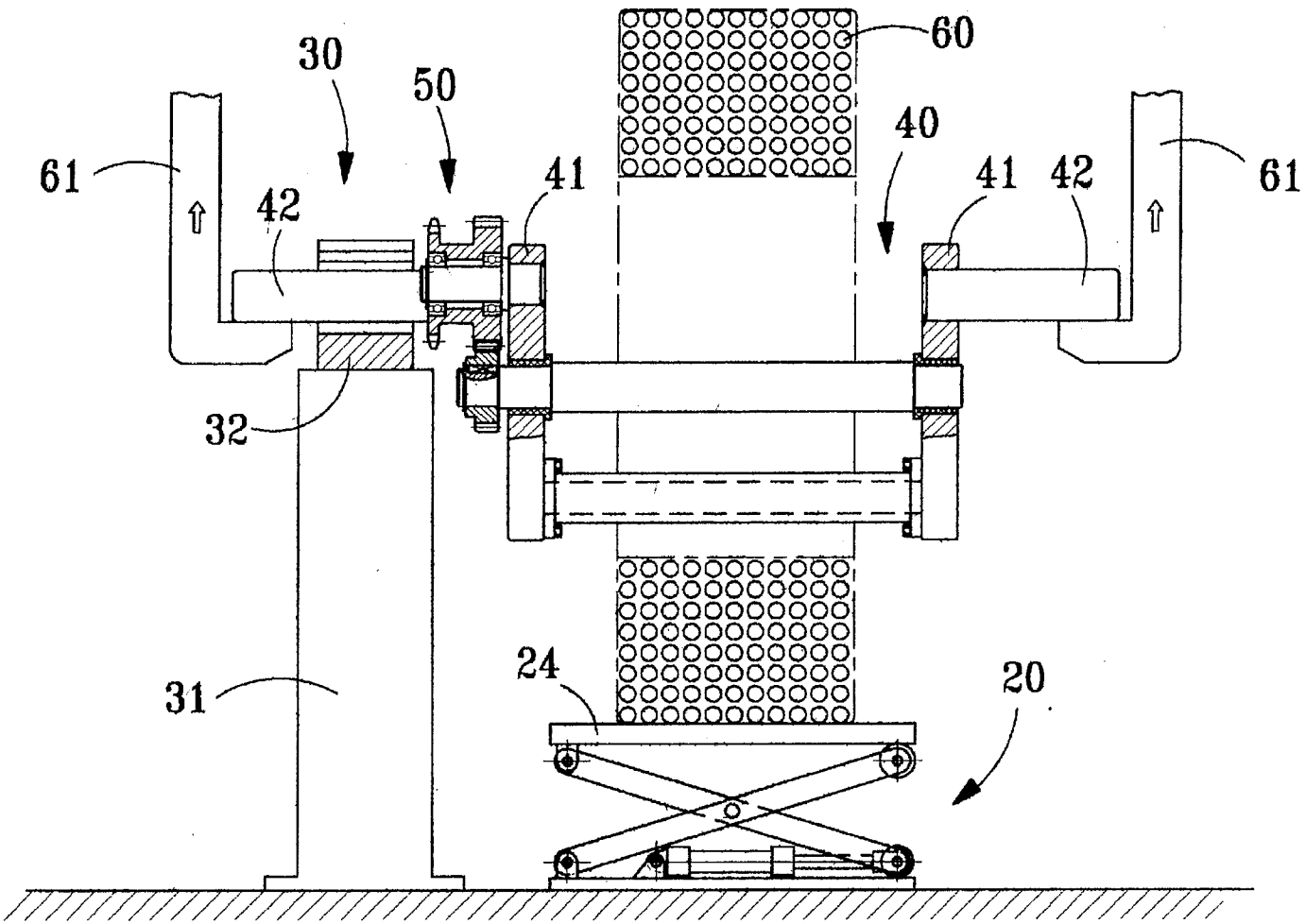
FIG. 7 is a pictorial view showing the invention being lifted by a hoist.
Figure 8:
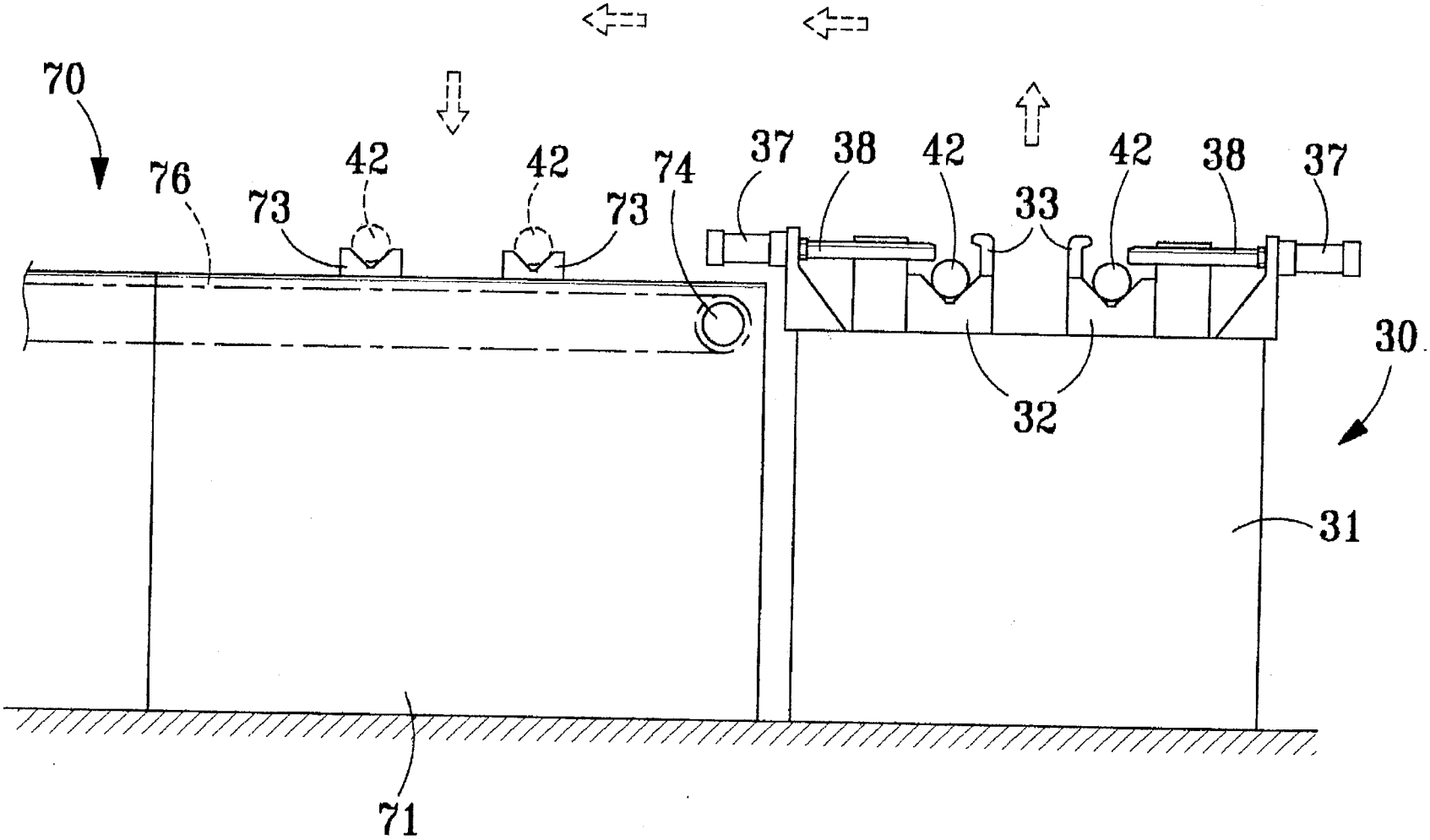
FIG. 8 is a pictorial view of the invention showing a process tank located behind the invention.

Refer to FIGS. 6, 7 and 8 for the operation of the invention. Suspending bar 42 on the left is firstly disposed on the V-shape block 32. Cylinder 37 is activated to have the piston shaft 38 engaging with the protrusive edge of the flange 33, thus firmly hold the suspending bar 42 in the V-shape black 32.

Then a roll material 60 is placed on the top of platform 24 and moved through another supporting board 41 via the central opening of the roll material 60. The roll material 60 is thus disposed over rotary shafts 48 and beams 47. Cylinder 37 is activated again to withdraw the piston shaft 38 from the V-shape block 32. A pair of hoist arms 61 then can be used to lift the suspending bars 42 and the roll material 60 (refer to FIG. 7) for moving the roll material 60 into the processing tank 70 (refer to FIG. 8).

Figure 9:
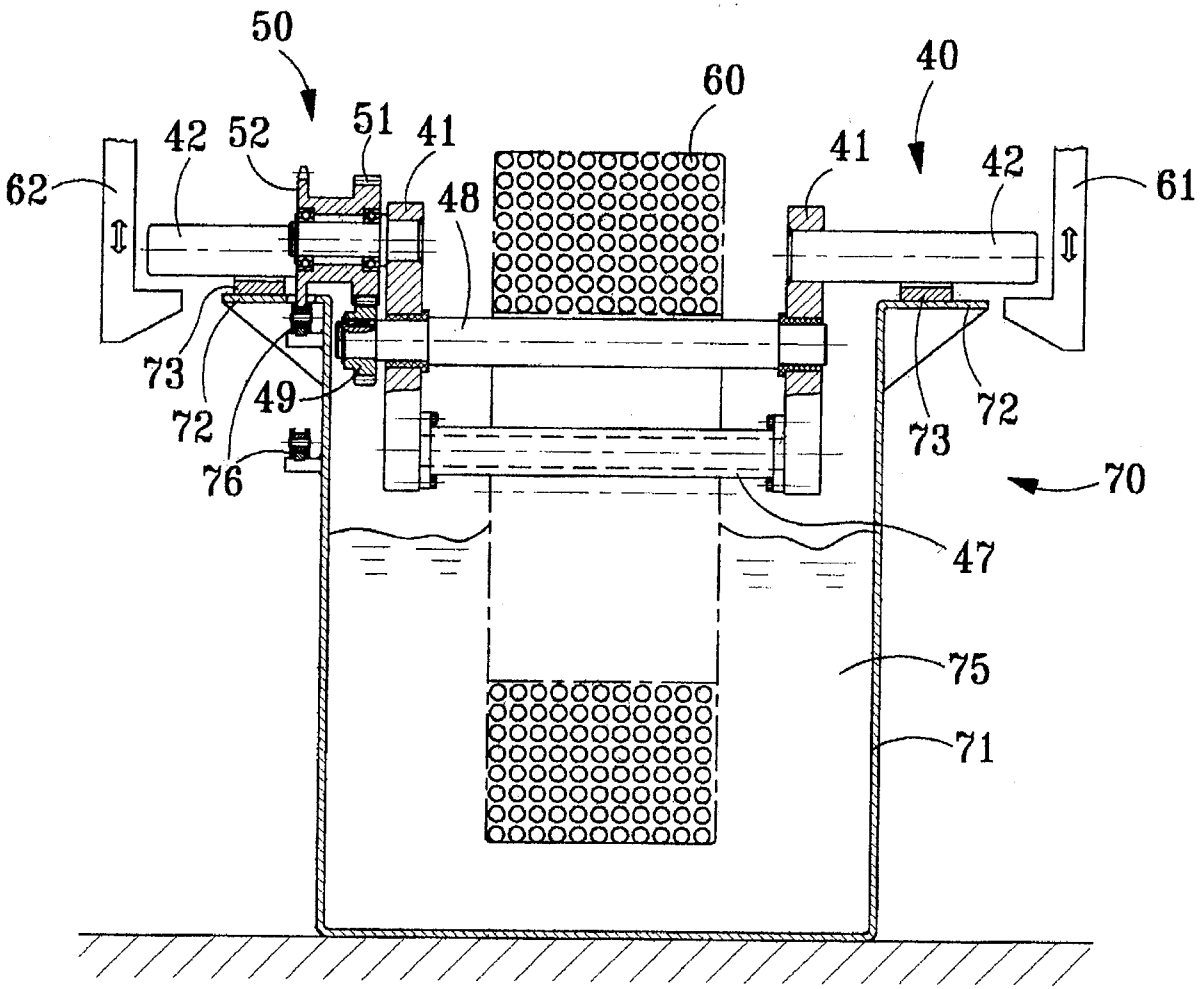
FIG. 9 is sectional view of the invention showing a roll material being immersed in a process tank.

Referring to FIGS. 8 and 9, processing tank 70 includes a liquid tank 71 containing processing liquid 75 and two support flanges 72 disposed respectively on two lateral sides. There are a pair of V-shape blocks 73 on the top of the support flange 72 for holding a pair of suspending bar 42 during surface treatment process. A motor reducer 74 which drives a chain 76 is disposed on one lateral side of the liquid tank 71. Upon the suspending bars 42 being placed on the V-shape blocks 73, chain wheel 52 will engage with the chain 76. Therefore when motor reducer 74 is activated and rotates, gears 51,49, rotary shaft 48 and the roll materal 60 suspending thereon will also be driven to rotate.

The roll material 60, suspending on a pair of rotary shaft 48, has the upper portion compressed between the layers due to its own weight, and has the lower portion stretched and formed relatively large gap between the laminated layers. The lower portion of the roll material 60 is immersed in the processing liquid 75. When the roll material 60 is rotated, processing liquid 75 is sipping into the gap of the layers in the lower portion and is squeezed out between the layers at the upper portion, thus enable the roll material 60 to have uniform surface treatment.

Figure 10:
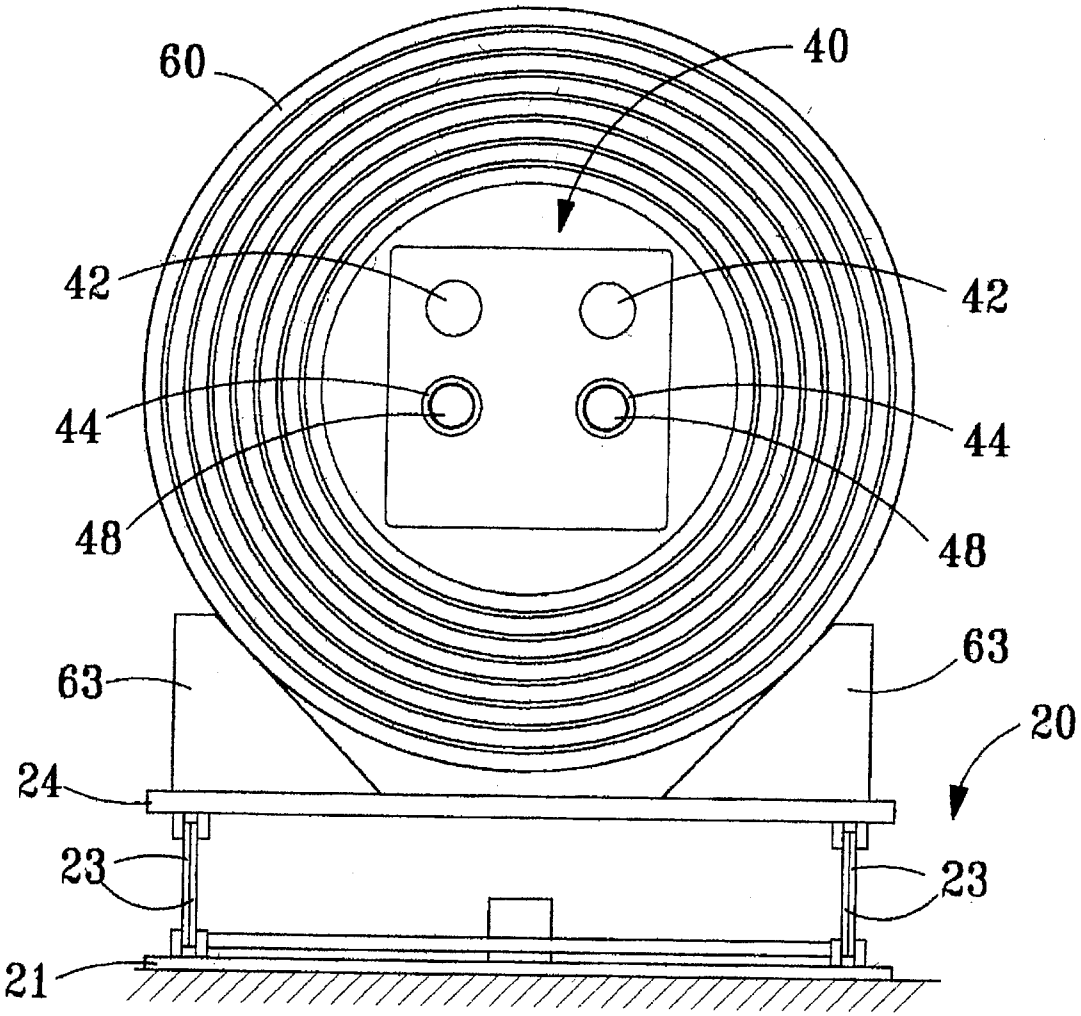
FIG. 10 is a side view of the second embodimart of the invention illustrating a triangle holding block.

FIG. 10 illustrates the second embodiment of the invention. There is a pair of triangle holding blocks 63 disposed on the top of the platform 24 so that roll material 60 can be securely positioned for hoist means 40 move in or out of the roll material.

Figure 11:
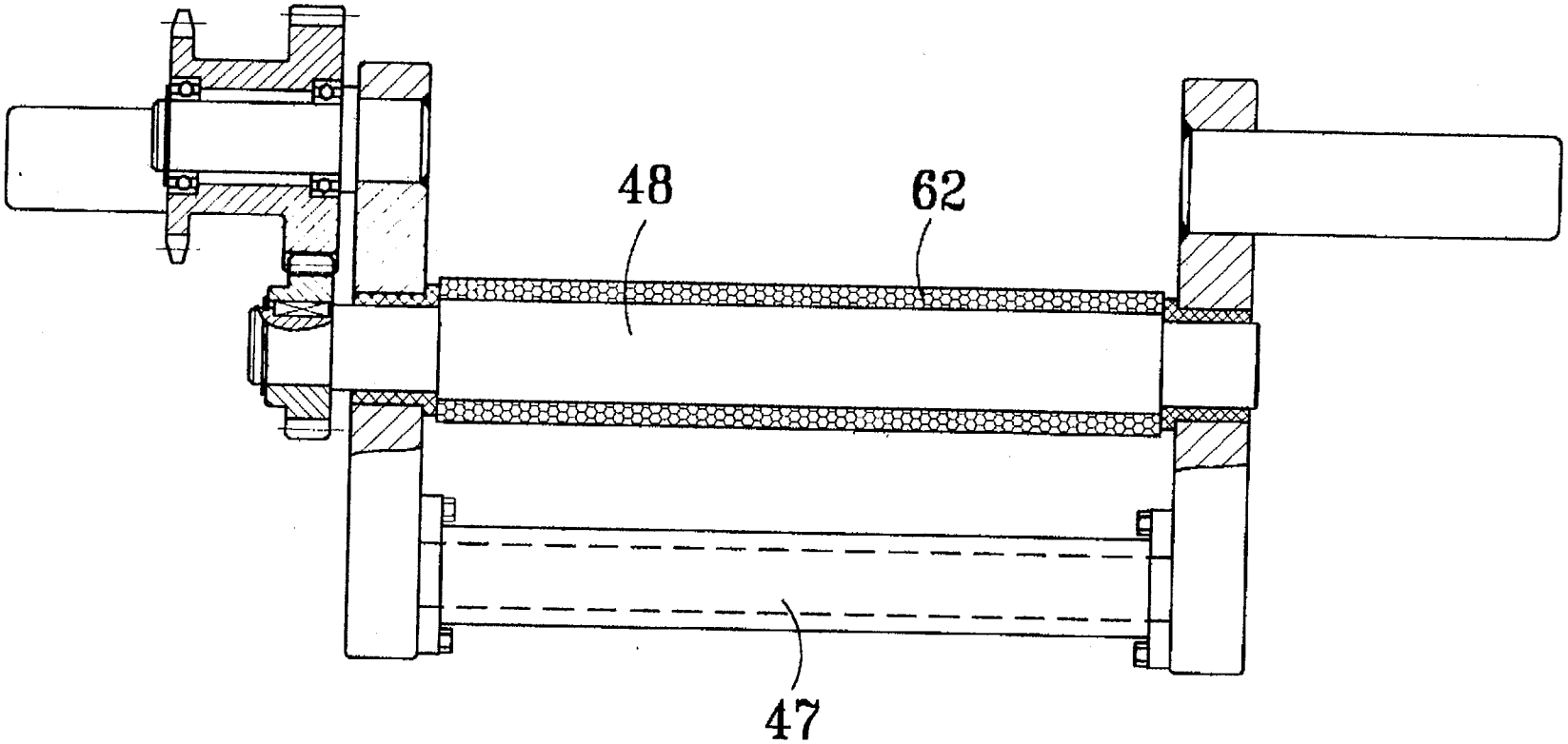
FIG. 11 is a sectional view of the third embodiment of the invention illustrating a covering layer on a rotary shaft.

FIG. 11 illustrates the third embodiment of the invention which has a covering layer 62 disposed around the circumference of the rotary shaft 48 to enhance the resilient and protective effect of the rotary shaft.

Many changes and modifications in the above described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A hoist for roll material surface treatment comprising:

a hoist means including a pair of spaced supporting boards having a plural number of suspending bars disposed on the top portion thereof and extending outward, at least one support beam engaged therebetween at the lower protion, at least one rotary shaft housed at both ends in a pair of bearings disposed in the supporting board, one end of the rotry shaft extending outward of the supporting board and having a driven gear fixed thereon, and a gear shaft disposed at same side of the driven gear;

a transmission means having a driving gear and a chain wheel disposed on the gear shaft through beatings, wherein the driving gear engages with the driven gear; and a securing means including a base frame, a pair of spaced V-shape block disposed on the top surface of the base frame, an upward flange having a protrusive edge disposed on one side of the V-shape block, a holding seat having an inverted T-shape slot disposed on another side of the V-shape block, an anchor block having a cylinder disposed therein located beside the anchore block, wherein the cylinder shaft of the cylinder is extendable and engageable with the protrusive edge of the upward flange to hold the suspending bar in the V-shape block.

2. A hoist of claim 1 further having a lift platform means disposed below the hoist means.

3. A hoist of claim 2, wherein the lift platform means including a base, a driving cylinder disposed on the base, cross linkage bars and a platform disposed on the top of the linkage bars, wherein the free end of cylinder shaft of the driving cylinder pivotally engages with one of the linkage bars such that when the driving cylinder is activated, the platform can be moved vertically upward or downward.

4. A hoist of claim 3 further having a pair of triangle holding blocks disposed on the platform.

5. A hoist of claim 1, wherein the rotary shaft having a coveting layer disposed around the circumference thereof for enhancing resilient and protective effect.

* * * * *